United States Patent [19]

Laipply et al.

[11] Patent Number: 4,745,894

[45] Date of Patent: May 24, 1988

[54] OIL DRAIN VALVE

[75] Inventors: Robert A. Laipply; Paul J. E. Fournier, both of Jackson, Mich.

[73] Assignee: Aeroquip Corporation, Jackson, Mich.

[21] Appl. No.: 100,887

[22] Filed: Sep. 25, 1987

[51] Int. Cl.[4] ..... F01M 1/00

[52] U.S. Cl. ..... 123/196 R; 123/196 S; 184/1.5; 251/149.1

[58] Field of Search ..... 123/196 R; 184/1.5, 184/106; 251/149.1, 149.6, 149.7, 149

[56] References Cited

U.S. PATENT DOCUMENTS

| | | | |
|---|---|---|---|
| Re. 28,844 | 6/1976 | Dehar | 184/1.5 |
| 3,486,730 | 12/1969 | Potash | 251/149.7 |
| 3,727,638 | 4/1973 | Zaremba, Jr. et al. | 184/1.5 |
| 3,879,013 | 4/1975 | Hajek et al. | 251/149.6 |
| 3,948,481 | 4/1976 | Pollock | 184/1.5 |
| 4,025,048 | 5/1977 | Tibbitts | 184/1.5 |
| 4,269,237 | 5/1981 | Berger | 184/1.5 |

FOREIGN PATENT DOCUMENTS

| | | | |
|---|---|---|---|
| 603650 | 4/1960 | Italy | 251/149.6 |

*Primary Examiner*—E. Rollins Cross

*Attorney, Agent, or Firm*—Beaman & Beaman

[57] ABSTRACT

The invention pertains to an oil drain fitting for internal combustion engines which permits a quick draining of the oil. A body threaded into the conventional oil pan drain hole includes an axial passage having a tubular valve reciprocally mounted therein. The valve is open at its lower end and closed at its inner end having a head which seats against the inner end of the body. The lower end of the valve includes an abutment surface for engagement by a drain conduit fitting for axially displacing the valve inwardly to open the valve and permit flow therethrough. A cap may be mounted on the body to enclose the lower end of the valve when the fitting is not in use.

9 Claims, 1 Drawing Sheet

OIL DRAIN VALVE

BACKGROUND OF THE INVENTION

Replacement of the oil within the oil pan of internal combustion engines requires periodic draining and usually, the drain hole receives a threaded plug which is manually inserted and removed.

To facilitate maintenance and reduce the time required to drain engine oil it is desirable to have a quickly operable oil drain plug. However, it is of utmost importance that any plug or valve device used be dependable and free of malfunctioning in that the inadvertent leakage of oil would quickly destroy an internal combustion engine.

Quick release or quick connect oil drain fittings of the prior art have not been as dependable and easy to use as desired, and it is an object of the invention to provide an oil drain fitting for internal combustion engines which is economical to manufacture and dependable in use, permitting the rapid draining of oil from an engine.

Another object of the invention is to provide an oil drain fitting of the quick opening type wherein a tubular valve is employed in conjunction with a spring wherein the valve is constantly biased toward the closed position and will not inadvertently open due to vibration.

An additional object of the invention is to provide a quick opening oil drain fitting for internal combustion engines whereby a drain conduit fitting may be readily attached thereto, and the attachment of the conduit fitting to the drain fitting automatically opens the drain fitting valve to initiate flow therethrough.

In the practice of the invention a tubular body includes an inner portion exteriorly threaded for reception into the conventional drain hole in the oil pan of an internal combustion engine. The outer exterior surface of the fitting is provided with means for attaching a drain conduit fitting thereto. The particular type of connection structure is not of significance with respect to the novel concepts.

The drain fitting includes an axial passage having a tubular valve reciprocal therein between open and closed positions. The inner end of the valve is closed having a head and seal ring thereon which engages with the inner end of the body valve seat to seal the interior of the valve and the body passage. The lower or outer end of the valve is open, and includes an abutment surface in the form of a flange for engagement by a probe defined on the oil drain conduit fitting wherein insertion of the conduit fitting into the body axially displaces the valve seat from the end of the body permitting oil to flow through a port defined in the valve side wall.

A compression spring interposed between the body and valve axially biases the valve toward the closed position engaging the valve seat and valve head.

A dust cap may be mounted upon the outer end of the drain fitting body, and in one embodiment of the invention the body outer end includes an annular groove for receiving radially displaceable locking balls defined on the drain conduit fitting.

To reduce costs and insure dependability and strength of components the closed end of the valve is homogeneous with the valve walls, and the closed end defines a head having a lip which holds an elastomeric seal in location. The lip portion of the head is deformable in an axial direction such that the projected diametrical dimension of the deformed lip will be less than the diameter of the fitting body passage permitting the closed end of the valve to be inserted therein. Thereupon, the lip is deformed to its normal position transverse to the length of the valve confining the elastomeric seal within its groove and permitting the valve head to be in axial alignment with the inner end of the fitting body.

BRIEF DESCRIPTION OF THE DRAWINGS

The aforementioned objects and advantages of the invention will be appreciated from the following description and accompanying drawings wherein.

DESCRIPTION OF THE PERFERRED EMBODIMENT

Figure 2:
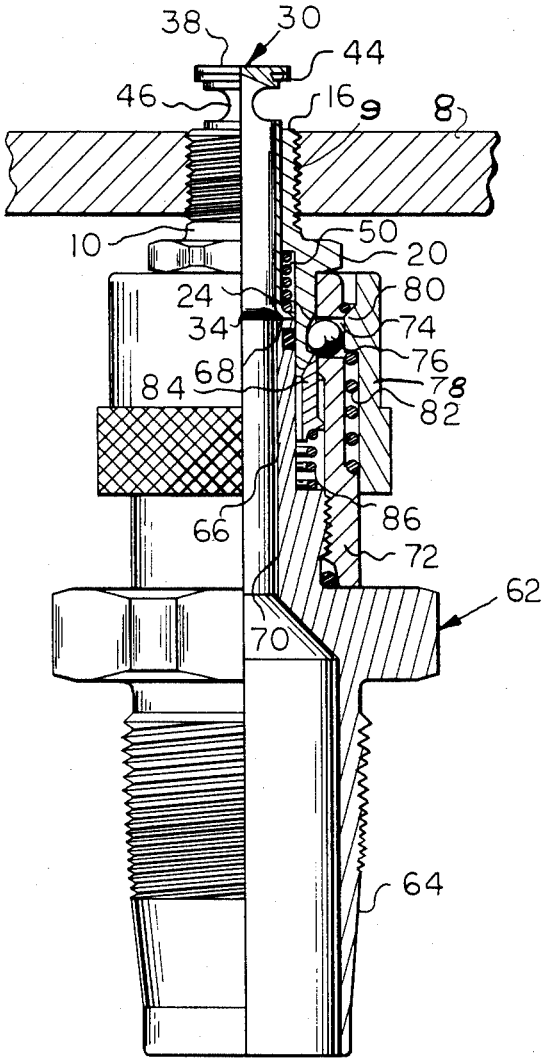
FIG. 2 is an elevational view, partially in section, illustrating the oil drain valve having an oil drain conduit fitting attached thereto wherein the valve is in the open position for draining oil.
Figure 1:
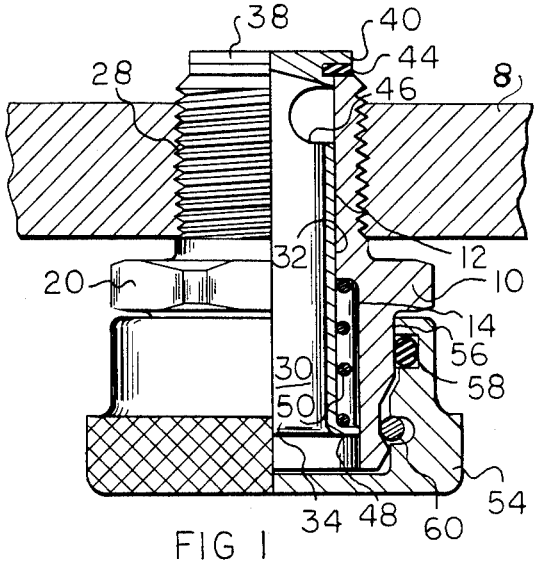
FIG. 1 is an elevational view, partially in section, illustrating an oil drain fitting in accord with the invention having a protective cap mounted thereon, the valve being shown in the closed position.

In FIGS. 1 and 2 the bottom of an internal combustion engine oil pan is illustrated at 8 having a threaded drain hole 9, as conventionally known. The oil drain fitting in accord with the invention includes a body 10 of an elongated tubular configuration having an axial passage 12 defined therein primarily of cylindrical form. The passage 12 includes an enlarged portion 14 adjacent its outer end. The body inner end 16 is of a planar configuration, FIG. 3, and the body outer end is represented at 18. Hexagonal flats 20 are defined on the body in order to permit torque to be applied thereto. The outer surface of the body adjacent the end 18 includes a cylindrical surface 22 having a locking ball groove 24 defined therein, and bevel 26 functions as a cam surface to radially displace the locking balls outwardly as later described. Also, the external inner portion of the body 10 is threaded at 28 wherein the body maybe tightly threaded into the oil pan hole 9.

The oil drain fitting valve 30 is of an elongated tubular configuration having an outer cylindrical surface 32 of slightly less diameter than the body passage 12 wherein the valve is axially reciprocal within the body. The outer or lower end 34 of the valve is open, while the upper or inner end 36 is closed. A head 38 is defined on the closed end 36 of the material of the body and the head includes a circumferentially extending lip 40 which is adjacent an annular groove 42 defined on the head for receiving the elastomeric seal 44. Ports 46 are formed in the valve wall adjacent the head 38 communicating with the valve interior, and the outer open end of the valve is provided with a circumferentially extending radial flange 48 which forms an abutment surface or actuating surface for the valve, as later described.

A compression spring 50 is interposed between the flange 48 and the body shoulder 52 imposing a continuous biasing force on the valve which maintains engagement of the seal 44 with the body end 16 which functions as a valve seat. It is to be appreciated that the spring 50 is not located within the flow passage through the valve 30.

A protective cap or cover 54 is preferably mounted upon the outer end of the fitting body 10 when the fitting is not being used for oil drainage purposes. The cap 54 prevents foreign matter from entering the open end of the fitting. The cap includes an annular surface 56 of slightly larger diameter than the valve body surface 22 and a seal 58 establishes a fluid-tight relationship between the valve body and cap. A metal snap ring 60 of the split type capable of radial contraction enters the ball groove 24 and maintains the cap upon the valve body upon the cap being fully placed thereon.

FIG. 2 illustrates a typical relationship between an oil drain conduit fitting and the drain fitting during draining. The conduit end fitting 62 includes a nipple 64 which is inserted into a flexible hose, now shown, and conventional socket structure, not shown, is employed to establish a sealed relationship between the fitting 62 and the hose. The fitting includes an annular probe 66 of a diameter receivable within valve body passage portion 14 for engagement of the probe end 68 with the flange 48, and as the probe is inserted into the valve body the probe will displace the valve 30 inwardly as apparent in FIG. 2. Fitting 62 includes the axial passage 70 communicating with the open end of the probe. A lock sleeve 72 is threaded upon the fitting 62 and includes radial holes 74 in which locking balls 76 are located for radial displacement. The ball sleeve 78 reciprocally mounted upon the lock sleeve 72 includes a cam surface 80 for engaging the balls 76 and biasing them inwardly into the valve ball groove 24, and spring 82 biases the ball sleeve 78 toward the locked condition. An annular ball retainer 84 is located within the lock sleeve 72 and is biased by compression spring 86 wherein the retainer 84 will be located inside of the balls 76 when the fitting 62 is removed from the drain fitting, and the retainer 84 will prevent loss of the locking balls.

Figure 3:
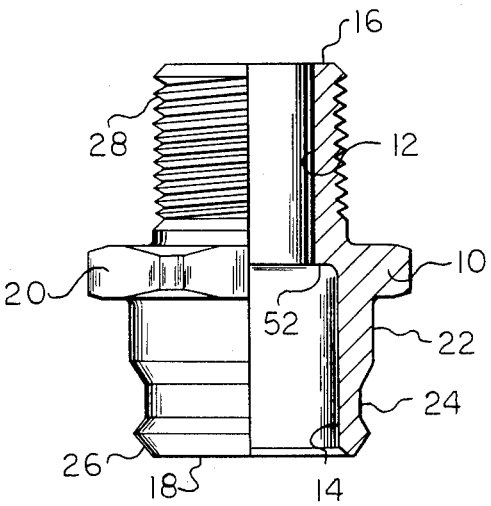
FIG. 3 is an elevational view, partially in section, illustrating the oil drain fitting body, per se.
Figure 4:
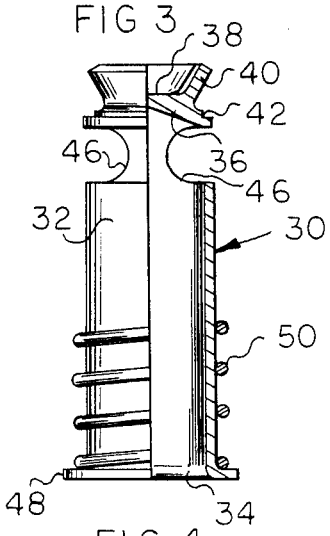
FIG. 4 is an elevational view, partially in section, illustrating the configuration of the oil drain fitting valve, per se, the head lip being in the deformed position.

It will be appreciated from FIGS. 1, 3 and 4 that the closed end 36 and head 38 of the valve 30 are homogeneously defined of the valve material, and as the lip 40 is also homogeneous with the head 38 and is of a greater diameter than the passage 12 it is not possible to assemble the valve within the body 10 in the manner shown in FIG. 1 without reducing the diameter of the lip 40. This is accomplished by deforming the lip 40 in the manner shown in FIG. 4. Such deformation reduces the projected diameter of the lip 40 to a dimension less than the passage 12 permitting the valve closed end 36 to be inserted through passage portion 14 and 12. After the head 38 extends past the body end 16 the lip 40 is swaged or deformed to the radial configuration of FIGS. 1 and 2 locating the lip 40 in a supporting position with respect to seal 44.

In use, the oil drain fitting will be assembled to the engine oil pan 8 as shown in FIG. 1. Preferably, the cap 54 will be mounted upon the outer end of the body to prevent dirt and foreign matter from entering the valve body and valve. When it is desired to drain oil from the crankcase pan 8 the cap 54 is removed by an axial pull, and the fitting 62 is aligned with the axis of the body 10. The probe 66 is inserted into the body passage portion 14 for engagement of the probe end 68 with the flange 48 of the valve 30. The fitting 62 is then inserted into and onto the body 10 such that the bevel cam surface 26 will engage the ball retainer 84, displace the balls 76 outwardly, and permit the balls to radially align with the ball groove 24. Of course, at such time the ball sleeve 78 is located toward the nipple portion 64 misaligning the cam 80 with the balls permitting the balls 76 to be outwardly radially displaced. Upon the balls 76 aligning with the groove 24 the cam 80 will bias the balls into the groove and establish the relationship shown in FIG. 2 wherein the fitting 62 is locked upon the body 10.

As the insertion of the fitting 62 onto the body 10 displaces the valve 30 to the open position of FIG. 2 oil within the pan 8 enters the ports 46 and drains through the valve 30 into the passage 70 of fitting 62 and into the drain hose, not shown. After the oil has been drained it is only necessary to displace the ball sleeve 78 toward the nipple 64 misaligning cam 80 from the balls and pulling the fitting 62 from the body 10. As soon as the balls 76 clear the body surface 26 the retainer 78 will be biased into place preventing inward deflection of the balls and the fitting 62 is ready to again be coupled to a drain fitting.

It will be understood that an oil drain fitting in accord with the invention is of economical construction and dependable and foolproof in operation. It is appreciated that various modifications to the inventive concepts may be apparent to those skilled in the art without departing from the spirit and scope of the invention.

We claim:

1. An oil drain fitting for internal combustion engines comprising, in combination, an elongated tubular body having an inner end and an outer end, a passage axially extending through said body intersecting said ends, an external thread defined on said body adjacent said inner end for threading said body into an engine drain hole, valve operating attachment means defined on said body adjacent said outer end, a tubular valve axially reciprocally mounted within said passage having an open end adjacent said body outer end and a closed end adjacent said body inner end, a valve seat defined on said body adjacent said inner end, a valve head defined on said valve closed end engagable with said seat when said valve is axially positioned to a closed position, a port defined in said valve adjacent said head communicating with the interior of said valve whereby oil will flow into said valve when said valve is axially positioned to an open position when said head disengages said seat, spring means mounted on said body axially biasing said valve toward said closed position, and valve actuating means defined on said valve for axially displacing said valve from said closed position to said open position.

2. In an oil drain fitting as in claim 1, said valve operating attachment means comprising drain conduit fitting connection means defined on said body adjacent said outer end for receiving a fitting having a probe for engaging said valve actuating means.

3. In an oil drain fitting as in claim 1, an annular seal ring mounted on valve head engagable with said valve seat, said valve seat being defined by said body inner end.

4. In an oil drain fitting as in claim 3, said valve head including a lip having a diameter greater than the diameter of said passage at its intersection with said body inner end, said seal ring being located adjacent said lip and in axial alignment with said body outer end.

5. In an oil drain fitting as in claim 1, said valve actuating means comprising an abutment defined upon said valve adjacent said open end.

6. In an oil drain fitting as in claim 1, said valve actuating means comprising a radially outwardly extending flange defined upon said valve open end.

7. In an oil drain fitting as in claim 6, said spring means comprising a compression spring interposed between said flange and said body.

8. In an oil drain fitting as in claim 6, said valve comprising a substantially cylindrical thin wall tube having a closed end closed by the tube material, said valve head being homogeneously defined on said closed end and including an annular lip of a diameter greater than that of said tube, said lip being deformable away from said tube open end to define an axially projected diameter less than that of said tube and passage whereby said valve closed end may be inserted into said body passage and said lip may be radially deformed outwardly to axially align with and overlie said body inner end.

9. In an oil drain fitting as in claim 8, an annular seal recess defined in said valve head adjacent said lip, an elastic seal within said recess, said lip retaining said seal within said recess upon being deformed to align with said body inner end.

* * * * *